US005624252A

United States Patent [19]

Charles, Sr. et al.

[11] Patent Number: 5,624,252

[45] Date of Patent: Apr. 29, 1997

[54] LOW NO BURNER

[75] Inventors: John G. Charles, Sr., Tyler, Tex.; Benny P. Dimarco, Cicero; Dennis C. Jones, Clay, both of N.Y.

[73] Assignee: Carrier Corporation, Syracuse, N.Y.

[21] Appl. No.: 578,408

[22] Filed: Dec. 26, 1995

[51] Int. Cl.[6] ..... F23D 3/40

[52] U.S. Cl. ..... 431/7; 431/328; 126/91 A

[58] Field of Search ..... 431/7, 326, 327, 431/354, 328, 329; 126/91 A, 92 R, 92 AC

[56] References Cited

U.S. PATENT DOCUMENTS

| | | | |
|---|---|---|---|
| 3,324,921 | 6/1967 | Fox et al. | 431/328 |
| 3,732,059 | 5/1973 | Goodnight et al. | 431/286 |
| 4,018,553 | 4/1977 | Baker et al. | 431/7 |
| 4,311,447 | 1/1982 | Rackley et al. | 431/7 |
| 4,737,100 | 4/1988 | Schneill et al. | 431/3 |
| 5,037,293 | 8/1991 | Kirby | 431/328 |

*Primary Examiner*—James C. Yeung

[57] ABSTRACT

A porous, ceramic member defines both the burner and baffle. Gaseous fuel is supplied under pressure into a chamber and flows through the ceramic member and, in flowing, causes the aspiration of atmospheric air into the flowing gaseous fuel. The air-fuel mixture is ignited a short distance downstream of the chamber and the flame flows through the ceramic member and emerges from the ceramic member within the heat exchanger. The air mixing with the gaseous fuel causes turbulence and mixing of the gas and cools the flame prior to its reaching temperatures associated with the generation of thermal $NO_x$.

16 Claims, 1 Drawing Sheet

LOW NO BURNER

BACKGROUND OF THE INVENTION

In the complete combustion of common gaseous fuels, the fuel combines with oxygen to produce carbon dioxide, water and heat. There can be intermediate reactions producing carbon monoxide and hydrogen. The heat, however, can also cause other chemical reactions such as causing atmospheric oxygen and nitrogen to combine to form oxides of nitrogen or $NO_x$. While $NO_x$ may be produced in several ways, thermal $NO_x$ is associated with high temperatures, i.e. over 2800° F. The flame is zoned so that different parts of the flame are at different temperatures. $NO_x$ production can be reduced with the lowering of the peak flame temperature. The reduction in $NO_x$ can be achieved through turbulence of the gases being combusted and/or by heat transfer from the high temperature portion of the flame.

SUMMARY OF THE INVENTION

The present invention eliminates a conventional inshot burner. Gaseous fuel is directly fired into a porous ceramic baffle which extends into a heat exchanger tube. The induced draft draws gaseous fuel and atmospheric air into the baffle and the gas-air mixture is ignited within the baffle and the flame travels through the baffle into the heat exchanger. Because primary atmospheric air is drawn into the baffle at ambient temperature there is an immediate cooling of the flame and a suppressing of the peak temperatures reached since approximately 90% of the combustion air is primary air. This should be contrasted with cooling a flame from a higher temperature. Notches are provided in the baffle to assist in the supplying of secondary air. Because the gaseous fuel and air flow into the baffle, there is good mixing which also tends to lower the peak flame temperature and therefore lowers the generation of thermal $NO_x$.

It is an object of this invention to reduce the production of $NO_x$.

It is another object of this invention to eliminate the inshot burner, the burner rack, and burner flame shaper except for the gas manifold.

It is a further object of this invention to shorten the burner flame.

It is an additional object of this invention to provide a method of combustion employing an integral burner and baffle.

It is another object of this invention to provide an integral burner and baffle.

It is a further object of this invention to provide immediate cooling of the flame and mixing of the gas and primary air.

These objects, and others as will become apparent hereinafter, are accomplished by the present invention.

Basically gaseous fuel is injected into a porous ceramic member defining a burner and baffle causing primary atmospheric air to be drawn into the baffle causing immediate cooling of the flame from the gas which is ignited in the baffle. Secondary air is drawn into the heat exchanger The baffle extends into the heat exchanger and the flame emerges from the baffle in the heat exchanger.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
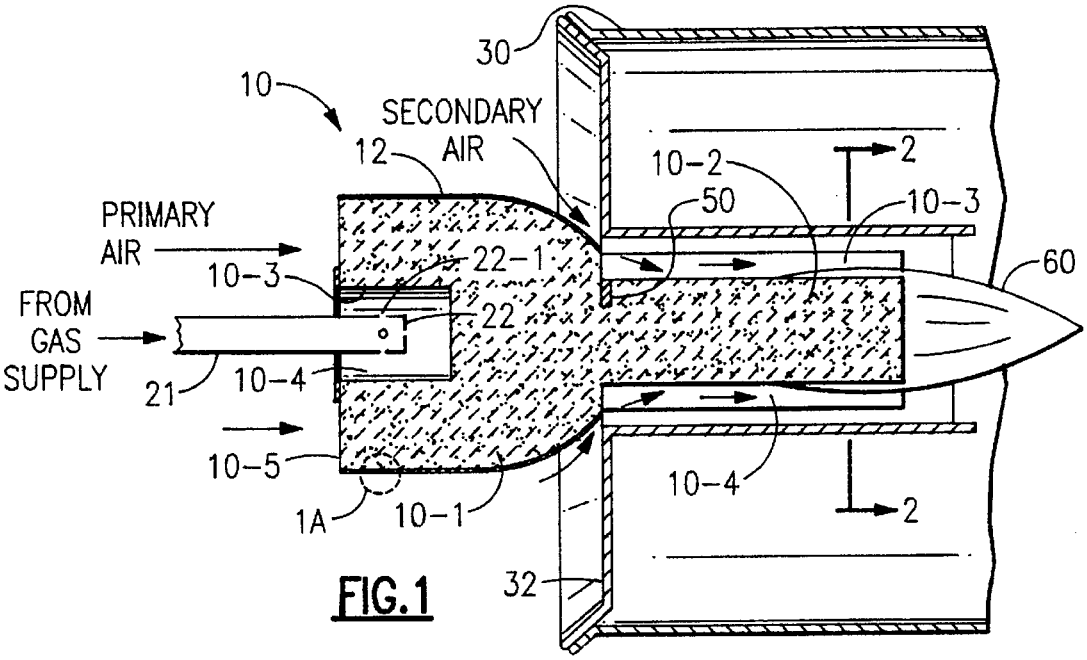
FIG. 1 is a sectional view of the low $NO_x$ burner of the present invention.
Figure 1A:
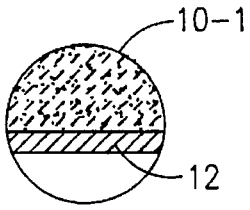
FIG. 1A is an enlarged view of a portion of FIG. 1.
Figure 2:
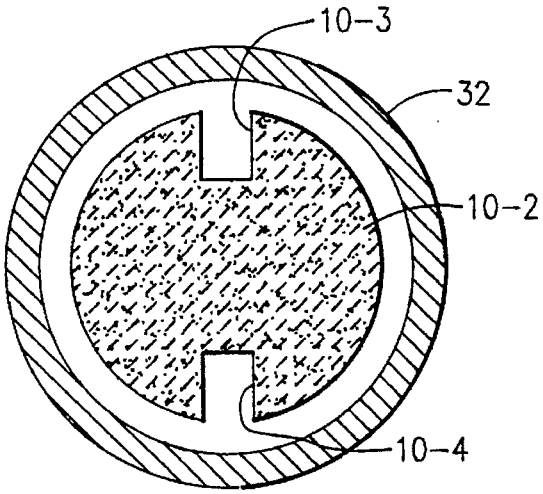
FIG. 2 is a sectional view taken along line 2—2 of FIG. 1.

In the Figures, the numeral 10 generally designates the combined burner and baffle member of a gas fired furnace. Member 10 is made of a porous material such as a silicon carbide material which is nominally two thirds silicon carbide, one quarter alumina with the reminder being silicon and having a porosity of 3 to 5 pores per inch. Member 10 is generally cylindrical with a typical length of eight inches and a diameter varying between about 3.0 inches for inlet end 10-1 which is located outside of heat exchanger 30 and 2.1 inches for outlet end 10-2 which is located within heat exchanger 30. The larger diameter and necessarily larger cross section of inlet end 10-1 results in a slower flow rate and better mixing in inlet end portion 10-1 upstream of igniter 50. A diametrically located pair of circumferentially spaced, axially extending notches 10-3 and 10-4 are provided in portion 10-2 which is located in heat exchanger 30. A suitable notch size has been found to be on the order of 2.0 inches wide, 0.75 inches deep and 5.0 inches long. Inlet end 10-1 of member 10 has an annular bore 10-3 extending a short distance into member 10 and receives spud 21 of a gas manifold (not illustrated) and coacts with spud 21 to define chamber 10-4. The outer cylindrical surface of inlet end 10-1 is coated with a suitable coating 12 to prevent the passage of gas through the outer cylindrical surface while permitting primary air to be drawn into the uncoated and open end surface 10-5 of inlet end 10-1. Spud 21 terminates in nozzle 22 which has, preferably, five orifices 22-1 for directing gaseous fuel axially and radially into chamber 10-4. Member 10 is located primarily in the burner compartment of the furnace but outlet end 10-2 extends approximately 5.5 inches into the bell orifice 32 of conventional heat exchanger 30. Also, there is a clearance between bell orifice 32 and outlet end portion 10-2 which is uncoated and contains notches 10-3 and 10-4 which thereby provide fluid communication for secondary air to be drawn into heat exchanger 30 along notches 10-3 and 10-4 with some of the secondary air passing into the burning air fuel mixture flowing in portion 10-2. Igniter 50 is located within member 10 at a point approximately 2.5 inches downstream of nozzle 22.

In operation, gaseous fuel, such as natural gas is supplied under pressure from the gas supply into chamber 10-4 via spud 21 and nozzle 22. Chamber 10-4 can suitably be of cylindrical shape with a length and diameter of, nominally, one half inch. The pressurized gas supplied to chamber 10-4 tends to spread through inlet end 10-1 and ultimately to travel generally axially with respect to member 10. Coating 12 prevents the escaping of fuel gas from inlet end 10-1 and restricts the entrance of primary air into inlet end 10-2 via the end surface 10-5. Coating 12 may be a dried slurry of the silicon carbide material from which the burner and baffle member 10 is made. The flowing pressurized fuel gas in member 10 is drawn into heat exchanger 30 by the inducer (not shown) and tends to aspirate primary air from the surrounding space into the member 10 via uncoated end surface 10-5 and into the fuel gas. Since both the fuel gas and atmospheric air are flowing in porous ceramic member 10 there is a mixing of the flows which makes for efficient combustion as well as heat transfer between the flows.

Approximately, 2.5 inches downstream of chamber 10-4, the fuel-air mixture is ignited by a conventional igniter 50 resulting in a flame 60 which travels with the gas flow into heat exchanger 30. Air aspirated into the flowing, burning gas thus tends to keep the flame temperature cooler rather than cooling it after it reaches a temperature conducive to thermal $NO_x$ production. Secondary air is drawn into heat exchanger 30 through the space between bell orifice 32 and portion 10-2 and into notches 10-3 and 10-4 with some of the secondary air being drawn into portion 10-2 and into the flame with further turbulence and heat transfer. Heat also radiates from member 10 which also tends to keep the peak flame temperature suppressed. The flame 60 exits member 10 within the heat exchanger 30 so that there is never a free flame exterior to the heat exchanger 30 since prior combustion is within member 10.

Although a preferred embodiment of the present invention has been described and illustrated, other changes will occur to those skilled in the art. For example, the number and size of the notches may be varied. It is therefore intended that the scope of the present invention is to be limited only by the scope of the appended claims.

What is claimed is:

1. A method of combustion comprising the steps of:

supplying gaseous fuel within a porous ceramic member;

flowing said gaseous fuel within said member so as to aspirate air into said flowing gaseous fuel so as to cause a mixture of gaseous fuel and air to be flowing in said member;

igniting said mixture within said member;

flowing said ignited mixture through said member into a heat exchanger while continuing to aspirate air into said member whereby said ignited mixture is cooled so as to avoid reaching undesirable temperatures.

2. The method of claim 1 further including the step of aspirating secondary air into said member at a point where said ignited mixture is flowing.

3. A low $NO_x$ burner comprising:

means for supplying gaseous fuel;

heat exchanger means;

a porous ceramic member connected to said means for supplying gaseous fuel and defining a fluid path between said means for supplying gaseous fuel and said heat exchanger;

ignition means for igniting said gaseous fuel within said porous ceramic member whereby said gaseous fuel flowing through said fluid path causes aspiration of air creating an air-fuel mixture while preventing said ignited gaseous fuel from reaching undesirable temperatures.

4. The burner of claim 3 wherein said ceramic member has a hollow chamber connected to said means for supplying gaseous fuel.

5. The burner of claim 4 wherein said ignition means is located downstream of said hollow chamber.

6. The burner of claim 5 wherein said porous ceramic member has a portion which is sealed and a portion adjacent said open means for supplying gas which is open whereby all primary air enters said member through said open portion adjacent said means for supplying gas.

7. The burner of claim 5 wherein said ceramic member extends into said heat exchanger and said ignited gases exit said ceramic member within said heat exchanger.

8. The burner of claim 3 wherein said ceramic member is made of a silicon carbide material.

9. The burner of claim 3 wherein said ceramic member has a porosity on the order of three to five pores per inch.

10. The burner of claim 3 having a secondary air path defined by a clearance between said member and said heat exchanger means and by recessed means in a portion of said member located in said heat exchanger means.

11. A low $NO_x$ burner comprising:

means for supplying gaseous fuel;

heat exchanger means;

a porous ceramic member having an inlet portion and an outlet portion with said inlet portion having a larger cross section than said outlet portion;

said inlet portion defining a portion for receiving primary air and a coated portion for preventing gas flow into and out of said inlet portion through said coated portion;

said inlet portion being connected to said means for supplying gaseous fuel;

said outlet portion being located in said heat exchanger means;

said porous ceramic member defining a fluid path between said means for supplying gaseous fuel and said heat exchanger means; and ignition means for igniting said gaseous fuel within said porous ceramic member whereby said gaseous fuel flowing through said fluid path causes aspiration of air creating an air-fuel mixture while preventing said ignited gaseous fuel from reaching undesirable temperatures.

12. The burner of claim 11 wherein said ceramic member has a hollow chamber connected to said means for supplying gaseous fuel.

13. The burner of claim 12 wherein said ignition means is located downstream of said hollow chamber.

14. The burner of claim 11 wherein said ceramic member is made of a silicon carbide material.

15. The burner of claim 11 wherein said ceramic member has a porosity on the order of three to five pores per inch.

16. The burner of claim 11 having a secondary air path defined by a clearance between said member and said heat exchanger means and by recessed means in said outlet portion.

* * * * *